United States Patent [19]

Schmidt et al.

[11] Patent Number: 4,577,669

[45] Date of Patent: Mar. 25, 1986

[54] FABRICATION OF GOLF CLUB HEADS

[75] Inventors: Glenn H. Schmidt, 1857 Los Encinos, Glendale, Calif. 91208; Howard F. Schmidt, S. Gate, Calif.

[73] Assignee: Glenn H. Schmidt, Glendale, Calif.

[21] Appl. No.: 636,486

[22] Filed: Aug. 1, 1984

Related U.S. Application Data

[63] Continuation-in-part of Ser. No. 406,337, Aug. 9, 1982, Pat. No. 4,472,092.

[51] Int. Cl.[4] ..... B22C 7/02

[52] U.S. Cl. ..... 164/45; 164/35; 164/412; 164/246

[58] Field of Search ..... 164/45, 44, 34–36, 164/246, 186, 412; 264/221, 317, DIG. 55; 249/61, 62; 294/61; 271/18.3; 414/729

[56] References Cited

U.S. PATENT DOCUMENTS 2,356,380 8/1944 Chollar .
2,604,351 7/1952 Rose et al. ..... 294/61
3,386,763 6/1968 Ottaway et al. ..... 271/18.3 X
3,405,212 10/1968 Fraser et al. .
3,410,942 11/1968 Bayer .
3,463,848 8/1969 St. Clair .
3,601,178 8/1971 Marticorena .
3,838,728 10/1974 Voegeie .
4,123,582 10/1978 Musyt .
4,472,092 9/1984 Schmidt ..... 164/45 X

*Primary Examiner*—Kuang Y. Lin
*Attorney, Agent, or Firm*—William W. Haefliger

[57] ABSTRACT

The method for transporting wax structure between first and second positions, and including (a) a support relatively movable into adjacency to said structure, (b) prong means associated with said support and movable relative thereto between retracted and advanced positions, the steps that include (i) advancing said prong means in non-parallel direction into said advanced position penetrating said wax structure, and (ii) displacing said support and prong means to transport said wax structure.

16 Claims, 9 Drawing Figures

FABRICATION OF GOLF CLUB HEADS

BACKGROUND OF THE INVENTION

This application is a continuation-in-part of my prior application Ser. No. 406,337, filed Aug. 9, 1982, now U.S. Pat. No. 4,472,092.

This invention relates generally to the production of metal golf club heads, as for example irons, and in some cases, metal woods. More particularly, it concerns methods and apparatus for achieving much higher rates of production of metal or head castings, than was previously possible.

Manufacture of such castings involves the production and transportation of wax replicas of the ultimate heads to be produced. The wax replicas are fragile and can be damaged during their transport as between mold cavities in which they are formed and the locations where they are coated with ceramic, in the lost wax process. Also, manual handling of the wax replicas is objectionably expensive. There is need for apparatus and methods overcoming such problems.

SUMMARY OF THE INVENTION

It is major object of the invention to provide automated apparatus and methods which meet the above need. Basically, the apparatus of the invention is adapted for transporting wax structure that includes a replica of a golf club head, and between first and second positions, such apparatus embodying:

(a) a support relatively movable into adjacency to said structure, (b) prong means associated with said support and movable relative thereto between retracted and advanced positions, the prong means in advanced position or positions penetrating said wax structure for carrying same during said transporting.

As will appear, the prong means may incorporate two prongs having axes of linear movement that are not parallel, and typically are convergent into the wax structure to enable "claw-like" pick-up of that structure with minimum deformation thereof. Such deformation may be repaired as by local heating at the mouth of the prong recess formed in the penetrated wax structure (typically a gate attached to the wax head), heating being carried out at the time of prong retraction so that the mouth of the recess is sealed. The remaining recess in the wax interior does not interfere with ultimate formation of the ceramic mold from which wax is melted and into which molten steel is poured. Also, the head itself is preferably not penetrated by the prong means.

Additional objects include the provision of means to soften a local area of the wax gate enabling adherence of that area, and of the gate, to a wax "tree" that transports or supports multiple wax structures in fixed positions for ceramic coating; and the provision of articulated robot arm means to displace the prong support, and prong supported wax structure, between multiple positions, as will appear.

These and other objects and advantages of the invention, as well as the details of an illustrative embodiment, will be more fully understood from the following specification and drawings, in which:

DRAWING DESCRIPTION

DETAILED DESCRIPTION

Figure 1:
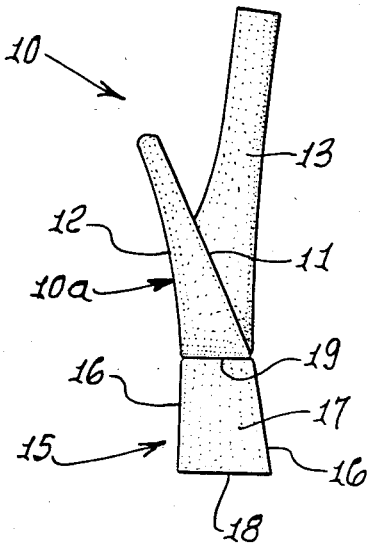
FIG. 1 is an end elevation showing a wax replica of a golf club head.
Figure 4:
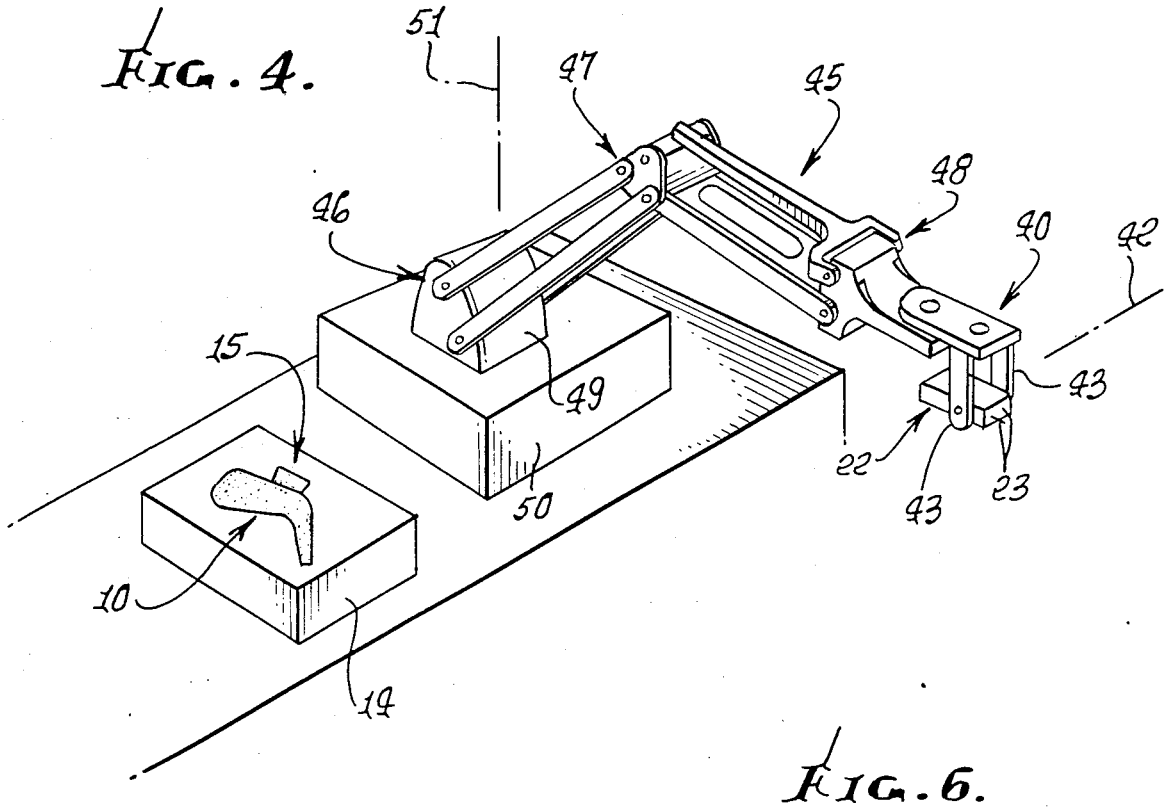
FIGS. 4–9 are perspective views of automated apparatus embodying the invention.
Figure 6:
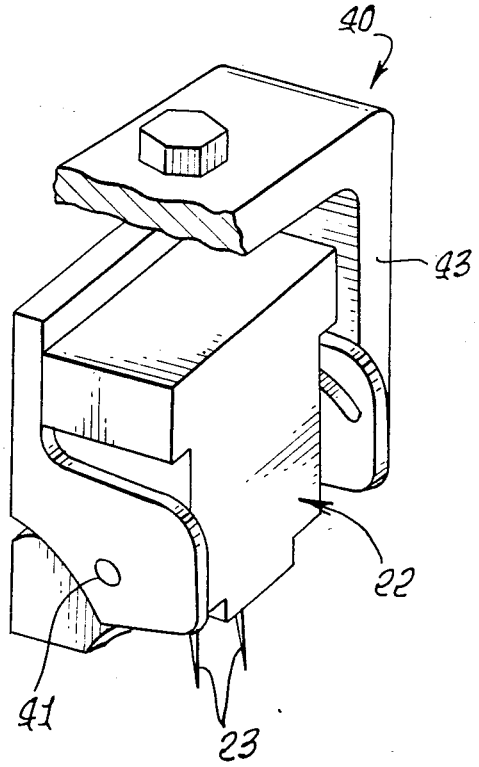
Figure 5:
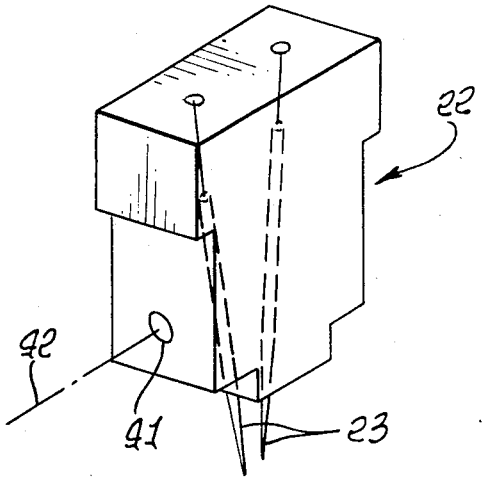
Figure 7:
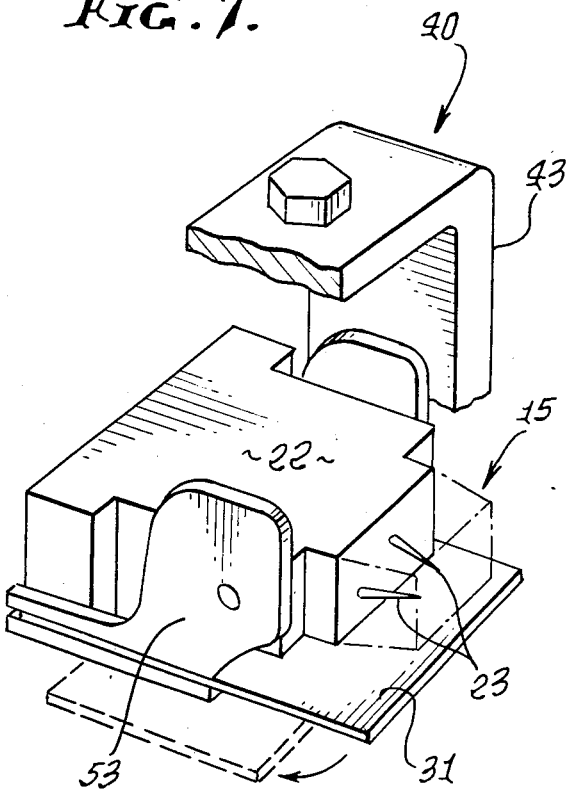
Figure 8:
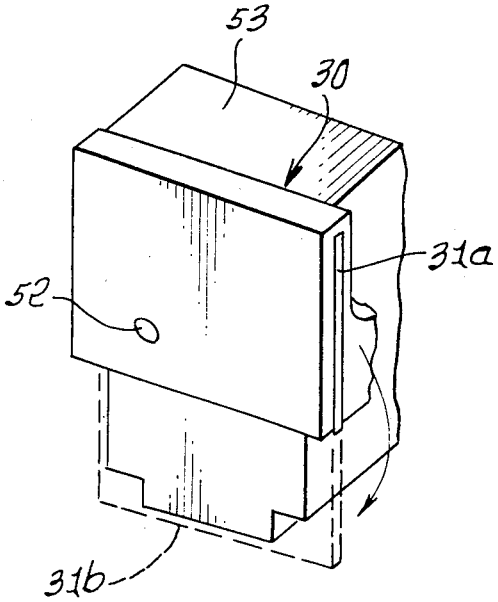
Figure 9:
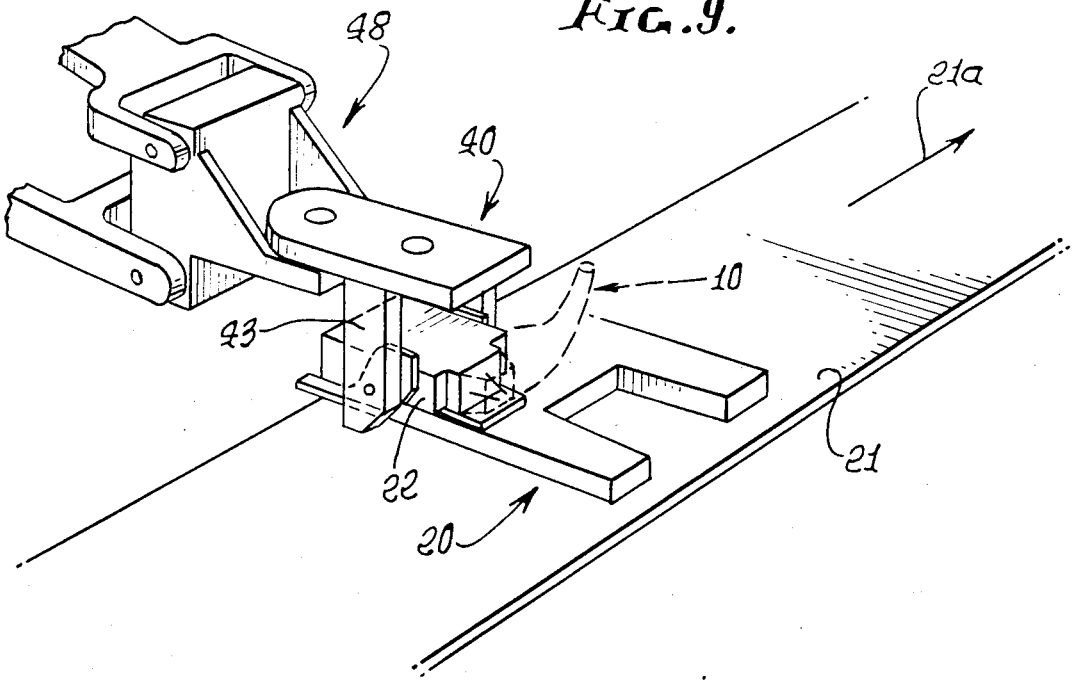

In FIG. 1, the wax replica structure includes a head 10*a* having a front face 11, rear side 12, and hosel 13. During formation of the replica, as in a mold 14 (see FIG. 4) a wax gate 15 is formed integrally with the head. The gate has opposite sides 16, opposite ends 17 and a flat bottom surface 18 furthest from the head to which the gate is attached at 19.

Figure 2:
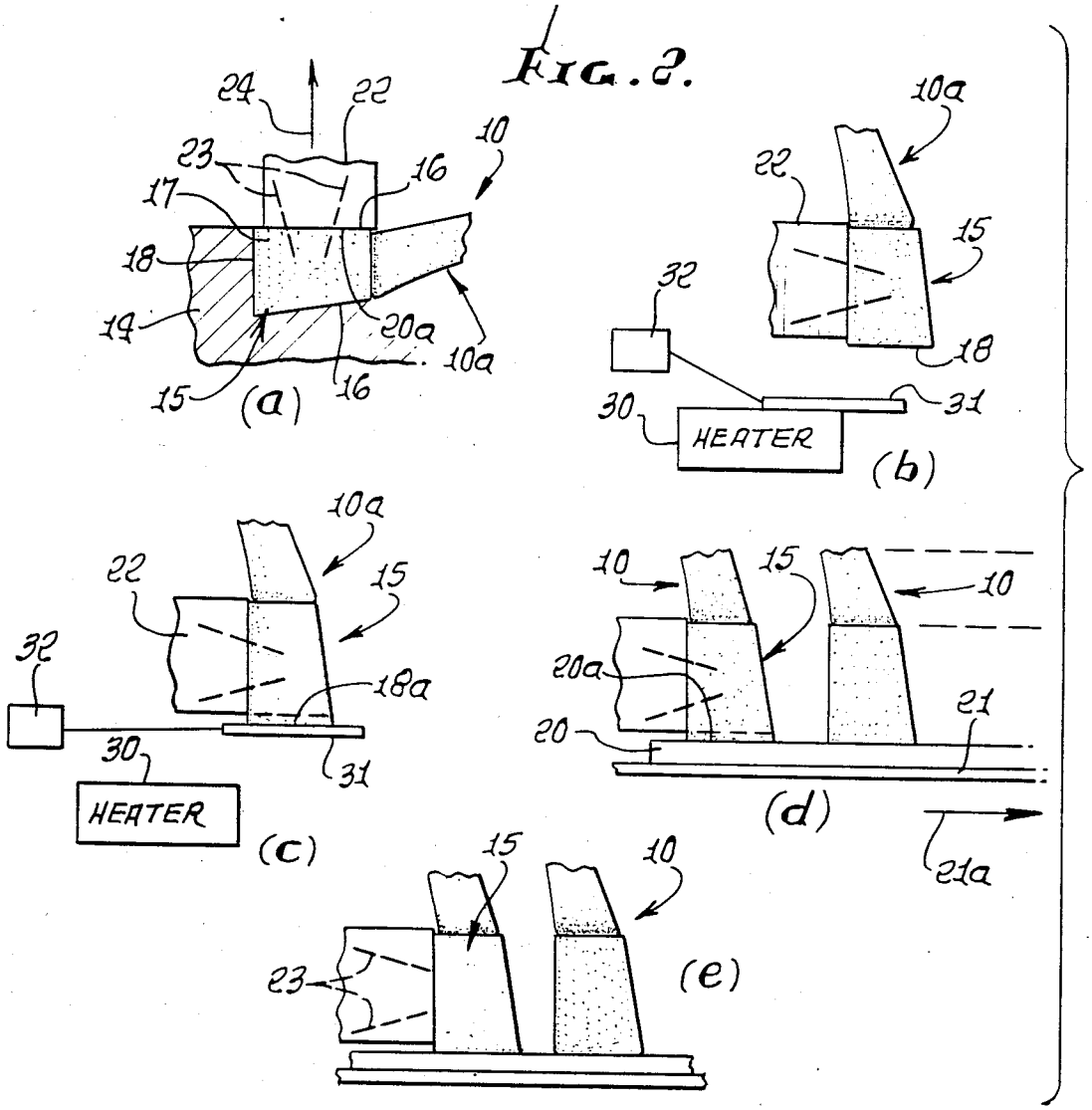
FIG. 2 shows stages (a)–(e) in handling of wax replica, in accordance with the invention.

In accordance with the invention, the structure 10 is to be transported between first and second positions. The first position for example may be as shown in FIGS. 2(*a*) and 4, i.e. in the mold 14; and the second position may for example be as shown in FIGS. 2(*d*) and 9, i.e. stacked on a transport means 20. The latter may include a wax "tree" i.e. transport sheet to which multiple replica structures 10 are adhered for displacement, as on a conveyor 21 moving in the direction of arrow 21*a*, for further processing.

In accordance with the invention, a support, as at 22 in FIG. 2(*a*) is relatively movable into adjacency to structure 10, and in particular to a side 16 of the wax gate 17. Thus, the side 22*a* of the support may engage the gate side. Prong means, associated with the support 22, and typically carried by the support is movable relative to the support between a retracted position or positions, and an advanced position or positions penetrating the structure 10, for example gate 17, for carrying same during transportation of the structure as between said first and second positions. While the prong means will be described as penetrating the gate in advanced position, the prong means may alternatively penetrate the head itself, or the hosel, these being part of the replica structure.

Figure 3:
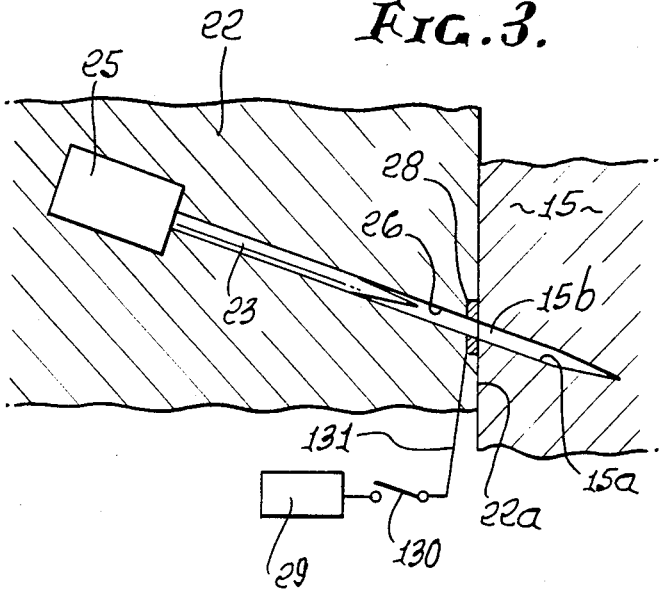
FIG. 3 is an enlarged fragmentary view showing details of prong penetration of the wax head replica.

FIG. 2(*a*) schematically shows the prong means to comprise two prongs 23 which have been axially advanced in directions along their lengths to penetrate the gate 17, so that when support 22 is subsequently relatively displaced in direction 24, the gate 17 and structure 10 will be lifted from the mold 14, for transport. As one example, FIG. 3 shows a prong 23 in the form of a needle which has been retracted by actuator 25 to retracted position. The needle is subject to axial advancement in bore 26 in the support 22 to cause the needle to penetrate the gate, forming an elongated needle shaped recess 15*a* in the gate. The two prongs 23 have axes of prong linear movement which are non-parallel, and typically such axes may be generally convergent in the direction of prong penetration into the wax structure, whereby the gate is firmly gripped (but only slightly deformed due to the small needle diameters) for positive transport of the structure 10 between the two positions referred to.

After the structure 10 has been transported to its second position, the prongs are retracted from the gate, as represented in FIG. 3. Heater means may be provided on the support to locally heat or melt the wax of the gate 15, thereby to seal the mouth 15*b* of the long recess 15*a* formed in the gate by the prong. Such heater means may for example take the form of an annular electrical resistor 28 about the bore 26 and adjacent face 22*a* of support 22. A source of electrical power or current is indicated at 29, and a switch 130 in lead 131 to the resistor may be closed for an interval to heat the resistor for sealing mouth 15*b*, as described.

Also provided is auxiliary means to soften a local surface area of the wax gate, whereby that area may be adhered to transport means, such as wax "tree" 20 previously described, for gate and head transport after prong retraction. FIG. 2(*b*) schematically shows the head and gate rotated about 90°, relative to FIG. 2(*a*), so that the head, 10*a* projects upwardly, and the surface 18 of the gate is presented downwardly. Electrical heater 30 is shown in FIG. 2(*b*) as heating a metallic blade 31 spaced from surface 18, and in FIG. 2(*c*) the blade has been shifted to engage the wax surface 18, for softening same as at 18*a*. Prongs 23 remain in penetrating positions at this time. A blade actuator appears at 32.

In FIG. 2(*d*), the softened surface 18*a* has been engaged against, and to adhere to, the surface 20*a* of wax "tree" or carrier. In FIG. 2(*e*) the prongs 23 have been retracted from the gate 15, and the supported heads are free to travel on conveyor 21.

In the specific showings of FIGS. 4–9, the support body 22 is preferably attached to carrier 40 at locations 41, to pivot about horizontal axis 42. Carrier 40 has spaced arms 43 to which support 22 is connected to pivot between a primary position (see FIGS. 5 and 6) associated with one position of the carrier (the gate "pick-up" position overlying mold 14) and a secondary position associated with the other or first carrier position (see FIG. 9), the degree of such pivoting being between 10° to 120° for example. A robot arm 45, articulated at 46–48 supports the carrier, to such transport, the arm being pivotally connected at 49 to base 50, to swing about a vertical axis 51.

The blade 31 is pivotally attached at 52 to the underside of bracket 53 (carried by arms 43), to swing between a retracted position 31*a* within a heater structure 30, and an advanced position 31*b* (corresponding to FIG. 2(*c*)) softening the bottom surface 18 of the gate.

Ultimately, the support tree 20, with the wax head replicas supported thereon, is coated with ceramic, the wax is melted out, and the ceramic coating is cured and inverted. Molten steel may then be poured into the head cavities via the gate cavities from wax was melted, to produce metal golf club heads.

The invention is also applicable to metal parts other than golf club heads.

I claim:

1. In apparatus for transporting wax structure including a replica of a golf club head between first and second positions, said structure having a gate, the combination comprising (a) a support relatively movable into adjacency to said structure, (b) prong means associated with said support and movable relative thereto between retracted and advanced positions, the prong means in advanced position or positions penetrating said gate for carrying said wax structure during said transporting, (c) and including auxiliary means to soften a local surface area of said wax gate whereby said softened area may be adhered to transport means for transport thereby, after retraction of said prong means from said gate.

2. The combination of claim 1 wherein said prong means include two prongs having axes of linear prong movement, said axes being non-parallel.

3. The combination of claim 2 wherein said axes are convergent in the directions of prong movement into said wax structure.

4. The combination of one of claims 1–3 including said wax structure penetrated by said prong means.

5. The combination of claim 1 including a carrier for said support, and an actuator connected with said carrier to displace the carrier between multiple positions in one of which the support is adjacent said wax structure as defined in sub-paragraph (a) of claim 1, and in another of which the wax structure is positioned on transfer means and for release by said prong means.

6. The combination of claim 1 wherein said auxiliary means comprises a heated blade, and including means for relatively advancing the blade into adjacency to said local surface area of the gate to heat-soften said area and for subsequently relatively retracting the blade away from said surface area.

7. The combination of claim 6 including a carrier for said support, the carrier also carrying the blade.

8. The combination of claim 7 wherein the support is pivotally attached to the carrier to pivot between a primary position associated with said one position of the carrier, and a secondary position associated with said other position of the carrier.

9. The combination of claim 8 wherein said primary and secondary positions of the support are between 60 and 120 degrees relative angularity.

10. The combination of claim 1 including said transport means which comprises a wax tree adapted to receive and support multiple wax gates adherent thereto.

11. In apparatus for transporting wax structure including a replica of a golf club head between first and second positions, the combination comprising (a) a support relatively movable into adjacency to said structure, (b) prong means associated with said support and movable relative thereto between retracted and advanced positions, the prong means in advanced position or positions penetrating said wax structure for carrying same during said transporting, (c) and including a heater means on said support to locally heat and melt surface wax of said structure to seal the mouth or mouths of an opening or openings formed in said structure after the prong means is retracted from said structure.

12. The combination of claim 8 including a robot arm supporting said carrier to displace the carrier and support as referred to.

13. In apparatus for transporting wax structure between first and second positions, the combination comprising (a) a support relatively movable into adjacency to said structure, (b) prong means associated with said support and movable relative thereto between retracted and advanced positions, the prong means in advanced position or positions penetrating said wax structure for carrying same during said transporting, (c) and including auxiliary means to soften a local surface area of said wax structure, whereby said softened area may be adhered to transport means for transport thereby, after retraction of said prong means from said wax structure.

14. In the method of transporting wax structure between first and second positions, and including (a) a support relatively movable into adjacency to said structure, (b) prong means associated with said support and movable relative thereto between retracted and advanced positions, the steps that include (i) advancing said prong means in non-parallel directions into said advanced position penetrating said wax structure, (ii) displacing said support and prong means to transport said wax structure, (iii) and wherein said wax structure has an associated gate penetrated by the prong means pursuant to step (i) and including the step of softening a local surface area of said wax gate whereby said softened area may be adhered to transport means for transport thereby, after retraction of said prong means from said gate.

15. The method of claim 14 including retracting said prong means from said wax structure after completion of said transport.

16. The method of claim 14 wherein said wax structure includes a replica of a golf club head, said prong means including two prongs which are advanced convergently, pursuant to step (i).

* * * * *